United States Patent [19]

Cooke

[11] Patent Number: 5,007,543

[45] Date of Patent: Apr. 16, 1991

[54] CRANE APPARATUS

[76] Inventor: Mack A. Cooke, 910 Neal St., Greensboro, N.C. 27403

[21] Appl. No.: 396,077

[22] Filed: Aug. 21, 1989

[51] Int. Cl.[5] ..... B66C 13/40

[52] U.S. Cl. ..... 212/160; 212/231; 200/298

[58] Field of Search ..... 212/159, 160, 162-164, 212/223, 227, 230, 231, 232, 237-238, 244-245, 247-248; 200/298; 182/148

[56] References Cited

U.S. PATENT DOCUMENTS

| | | | |
|---|---|---|---|
| 2,254,083 | 8/1941 | Nickles et al. | 212/160 |
| 2,832,849 | 4/1958 | Walter | 200/298 |
| 3,051,323 | 8/1962 | Kuhlenschmidt et al. | 212/160 |
| 3,173,550 | 3/1965 | Province | 212/238 |
| 3,313,107 | 4/1967 | Urish | 212/238 |
| 3,559,817 | 2/1971 | Brown | 212/160 |
| 3,749,870 | 7/1973 | Oakes | 200/298 |
| 3,931,486 | 1/1976 | Raetz | 200/298 |
| 4,508,014 | 4/1985 | Shoff | 212/160 |
| 4,566,599 | 1/1986 | Villa et al. | 212/160 |
| 4,635,802 | 1/1987 | Hylton | 212/160 |

FOREIGN PATENT DOCUMENTS

| | | | |
|---|---|---|---|
| 0257647 | 3/1988 | European Pat. Off. | 212/160 |
| 0149162 | 11/1979 | Japan | 212/160 |

OTHER PUBLICATIONS

Auto Crane Co., Catalog 23, BN20M 6-89.

Venturo ET and DT Series Truck Cranes, Brochure Form 2804 8/88.

*Primary Examiner*—Joseph F. Peters, Jr.

*Assistant Examiner*—R. B. Johnson

[57] ABSTRACT

Crane apparatus having a pendant control with two stage operational switches is provided for use with a control system for maximum precision and efficiency during operation. The two stage switches allow for fast or slow crane movement as required. Boom construction is also presented for easy manufacture and superior strength under load.

5 Claims, 6 Drawing Sheets

CRANE APPARATUS

BACKGROUND OF THE INVENTION

1. Field Of The Invention

The present invention pertains to crane apparatus having an extendable boom which may be mounted on small trucks, manually movable carts for use in the building and construction trade, or otherwise as needs dictate.

2. Description Of The Prior Art And Objectives Of The Invention

Cranes have become increasingly used in various trades in recent years for a variety of hoisting and lifting operations. Stationary cranes are oftentimes used for tall building and skyscraper construction whereas smaller, mobile cranes are employed for other commercial work. A third group of cranes consist of compact designs which are mounted on small trucks or which could be positioned on carts which can be manually rolled from site to site within a building or the like for handling heavy loads such as production machinery.

Smaller cranes in the past have had limited operating capabilities, were expensive to manufacture and did not have the precision controls required for safe and precise movement. Therefore, it is an objective of the present invention to provide crane apparatus suitable for mounting on a truck or a hand cart which includes a pendant control having a series of two stage switches to control the speed of operation.

It is yet another objective of the present invention to provide crane apparatus having a welded boom construction to provide maximum total machine rigidity under load.

It is still another objective of the present invention to provide a crane control apparatus which has a dual hydraulic pump unit whereby hydraulic fluid can be delivered to hydraulic motors or cylinders either under high or low volume as controlled by pendant switches, for speed control.

It is also an objective of the present invention to provide crane apparatus having a turret with an adjustable worm gear assembly which will eliminate "play" when then turret is not operating.

It is still another objective of the present invention to provide a pendant control which is affixed to the stationary base of the crane apparatus for convenience, safety and ease of use during operation and also providing continuous turret rotation.

Various other objectives and advantages of the present invention become apparent to those skilled in the art as a more detailed presentation is presented below.

SUMMARY OF THE INVENTION

The aforesaid objectives are realized by providing crane apparatus in which the boom structure is formed from four (4) planar steel members with the top and bottom members positioned inwardly along the side members with continuous weld joints along the outer surfaces of the top and bottom members for maximum strength. The crane apparatus is controlled by a unique hand held pendant which is attached by an electrical cord to the stationary base of the crane apparatus. The pendant includes a plurality of two stage switches contained thereon. Thus, by pressing a switch, for example to raise the boom, the boom will begin lifting at a relatively slow speed whereby, upon further depressing said switch to a second stage the crane will then move in a relatively rapid fashion.

The control system of the apparatus includes a dual unit hydraulic pump which during the first stage operation (pendant switch depression), pumps at a relatively low volume and during the second stage operation (further switch depression) by the use of a second pump, a higher volume of fluid is delivered for greater operating speed. A worm gear assembly is hydraulically driven for controlling the rotational speed of the crane turret. A worm gear member is enmeshed with a ring gear of the turret whereby, upon deactivating the hydraulic drive motor, the ring gear cannot turn thereby providing a self-locking unit for precise and accurate turret control to thereby eliminate any "play" in the turret rotation.

DESCRIPTION OF THE PREFERRED EMBODIMENT

Figure 3:
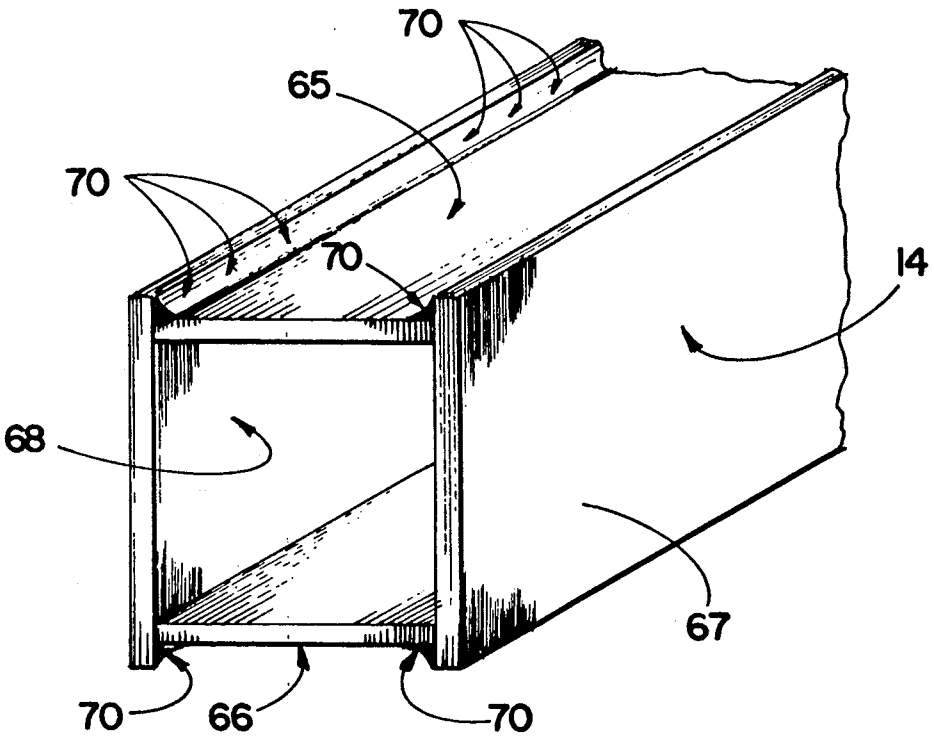
FIG. 3 shows in cross-sectional form the rectangular boom construction of the present invention.
Figure 2:
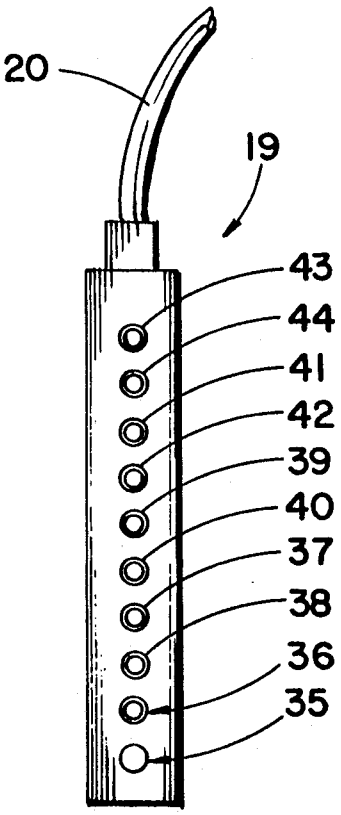
FIG. 2 illustrates the pendant control having a series of dual stage switches thereon.
Figure 5:
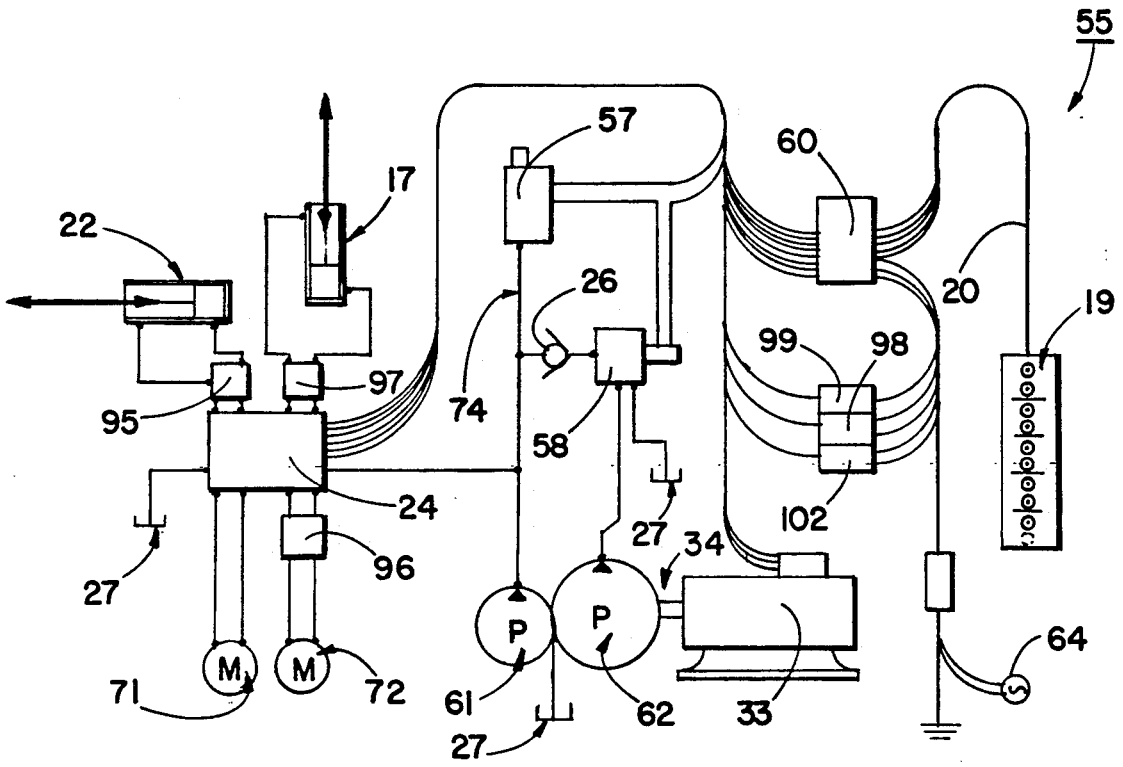
FIG. 5 shows a schematic layout of the hydraulic system of the invention.
Figure 6:
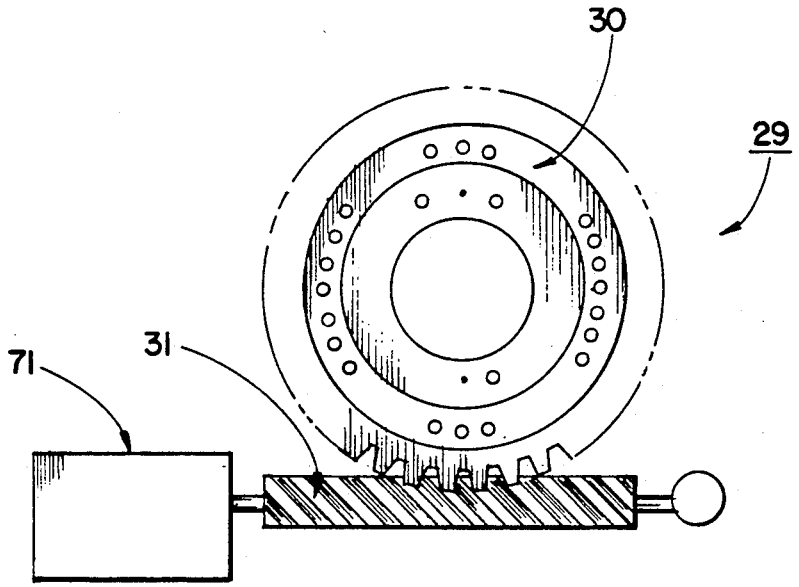
FIG. 6 illustrates the worm gear assembly.

The preferred form of the crane control system is shown in FIG. 5 with a dual pump unit controlled by the pendant as featured in FIG. 2 having a plurality of dual stage switches. The dual stage switches provide either a high or low speed to the variety of crane operations such as turret rotation, boom lift, boom extension and retraction and winch speed. The boom is constructed in a manner for maximum strength as seen in FIG. 3 with the top and bottom members positioned inwardly from the top and bottom of the side members respectively thereby placing the weld joints under compressive forces during boom loading. The worm gear assembly as seen in FIG. 6 is used for turret rotation and prevents any "play" in the turret thereby adding a safety feature to the crane operation.

DETAILED DESCRIPTION OF THE DRAWINGS AND OPERATION OF THE INVENTION

Figure 1:
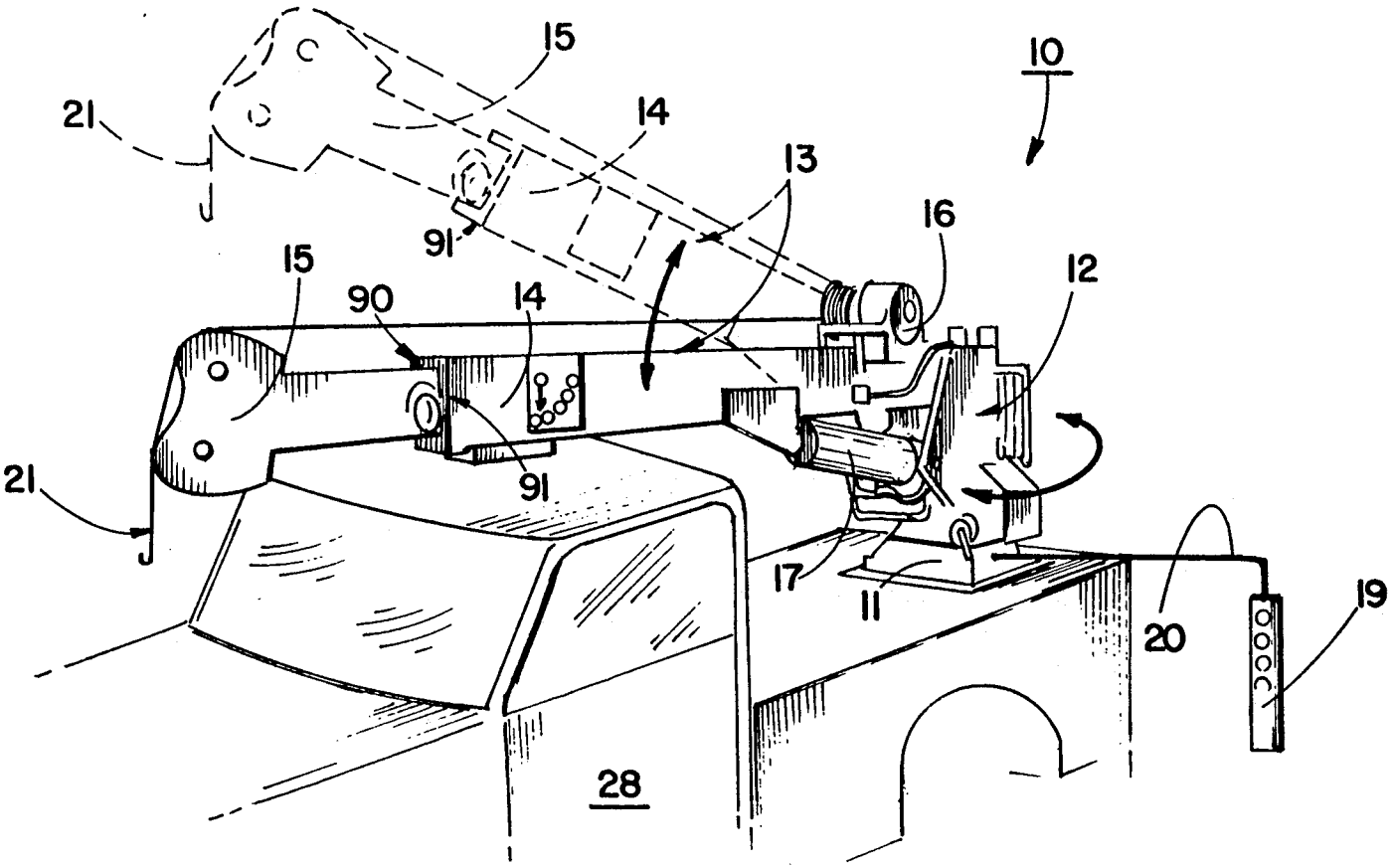
FIG. 1 illustrates crane apparatus of the present invention mounted on a small truck.

For a better understanding of the invention and its method of operation, turning now to the drawings, crane apparatus 10 is shown in FIG. 1 mounted on a small, one ton truck 28. Crane apparatus 10 includes stationary base 11 and rotatable turret 12 which is driven by hydraulic motor 71 attached to worm gear 31 which in turn rotates around ring gear 30 as shown in FIG. 6. Worm gear assembly 29 is enclosed within the housing of turret 12 and base 11. Pendant control 19 as seen in FIG. 1 is connected by electrical cord 20 to base 11 of crane apparatus 10 for convenient remote control thereof. Boom 13 includes an outside boom segment 14 and an inside extendable boom segment 15. To illustrate the size of crane apparatus 10, the dimensions of base 11 may be approximately eighteen (18) inches square and the height of base 11 and turret 12 approximately forty (40) inches. Overall the length of boom 13 and turret 12 may be approximately one hundred twenty-three (123) inches and boom 13 it may extend from nine and one-half (9½) feet to approximately fourteen and one-half (14½) feet. Vertical movement of boom 13 may be from a ten (10) degree position below the horizon to approximately seventy-five (75) degrees above the horizon for total motion of eighty-five (85) degrees. By use of two-stage pendant switches, turret rotation of three hundred sixty (360) degree rotation at the slow speed (first stage) may take approximately ninety (90) seconds where at the second stage the rotation may take only twenty-eight (28) seconds. The eight-five (85) degree boom motion by boom extension cylinder 22 may occur at stage one in approximately sixty (60) seconds from minus ten (−10) from horizon to plus seventy-five (+75) degrees and under the second stage or higher speed may occur in eighteen (18) seconds. The downward motion of the boom may occur under the first or slow stage in forty-six (46) seconds whereas the fast stage downward motion will occur in fifteen (15) seconds. The full sixty (60) inch travel of inside boom segment 15 may occur under the first stage in forty-four (44) seconds for extension versus twelve (12) seconds for fast extension. The inward (boom retraction) speed may be approximately twenty-nine (29) seconds for withdrawal and nine (9) seconds under the second or faster stage. The winch line speed may be for a five sixteenth (5/16th) inch rope on a four (4) inch drum at a slow speed of eight (8) feet per minute and a fast speed of twenty-five (25) feet per minute. A water or weather seal 90 is provided on inside boom segment 15 (FIG. 1) which engages end 91 of outside boom segment 14. Seal 90 is formed from a durable rubber or other resilient material to prevent water from entering end 91 of outside boom segment 14 during rainstorms or otherwise.

Electric power for operation can be obtained from a 30 amp 11OV source 64 (FIG. 5) or 15 amp 220V source 101 (FIG. 4) and a conventional portable welder power generator can be utilized if 110V service is not readily available for electrical circuitry 55 as seen in FIG. 5, such as for use in remote power locations.

As further shown in FIG. 1, winch 16 is mounted on top of boom 13 and can be moved to any position therealong. Extending therefrom is winch line 21 which may be for example a rope or cable of suitable size and dimensions depending on the particular load requirements. Hydraulic boom lift cylinder 17 is shown affixed to turret 12 and boom 13 which provides vertical lift to boom 13 as is conventional in the art. A cross-section of outside boom segment 14 is shown in FIG. 3 in rectangular cross-sectional fashion. Boom top member 65 and boom bottom member 66 are positioned "inside" of the boom right side member 67 and boom left side member 68 with continuous weld 70 along the outside thereof. By the use of this construction, outside boom segment 14 will always have weld 70 under compression as outside boom segment 14 is loaded thereby providing strength thereto. If welds 70 were not compression loaded, strength diminishing of boom 13 would occur. Inside boom segment 15 is likewise constructed and welded as described above for boom segment 14.

It is of concern during crane operation that turret 12 not rotate inadvertently or "coast" when the power is removed therefrom. Sometimes if a conventional crane is not on level terrain the turret will tend to rotate to compensate for its unlevel position which can be inconvenient or under certain circumstances, dangerous to workmen nearby. Such undesired motion has been overcome in the present invention by utilizing a worm gear assembly 29 as shown in FIG. 6 which includes a ring gear 30 connected to worm gear 31. Worm gear 31 is driven by hydraulic motor 71, worm gear assembly 29, due to the gear ratio prevents inadvertent turret motion. Thus, when hydraulic motor 71 is deactivated, worm gear 31 immediately ceases rotation and turret 12 likewise will not turn. Although boom 13 may be loaded, the pressure of ring gear 30 on worm gear 31 will not be sufficient to cause further rotation of turret 12 for additional safety. Counter balance valves 95, 96 and 97 as shown in FIG. 5 prevent boom movement in the event of hydraulic or electric power loss, thereby providing another safety feature.

The control system of the invention is provided utilizing pendant control 19 which is joined to crane apparatus 10 through stationary turret base 11.

Figure 4:
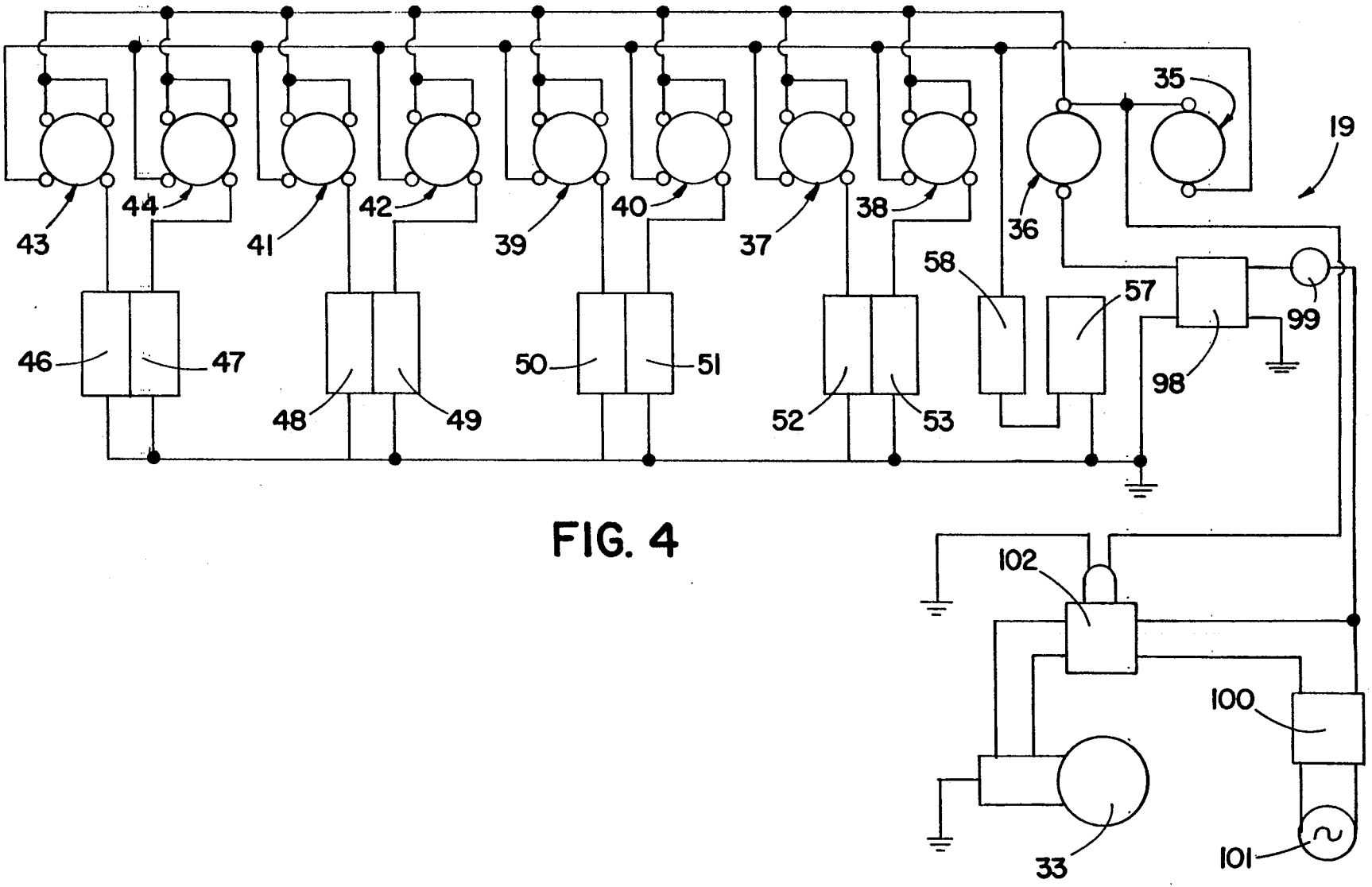
FIG. 4 demonstrates an electrical schematic of the control pendant.

In FIG. 2, and as schematically represented in FIG. 4, pendant control 19 includes a plurality of dual stage switches 37–44 for controlling various operational functions of crane apparatus 10. Switches 37–44 are two stage, i.e. by depressing one of the switches to the first stage, a slower operation takes place and by further depressing the switch, high speed operation occurs. Also, pendant on/off switch 36 is shown which stops the total operation of crane apparatus 10, including all electric and hydraulic operations. Pendant power light 35 is also provided. Slip ring assembly 60 as seen in FIG. 5 provides electrical connection to pendant control 19 which is joined to stationary turret base 11 through revolving turret 12.

In FIG. 4, switch 37 is a two stage switch with button activator which controls the upward movement of boom 14 whereas switch 38 controls the downward motion. Switches 39 and 40 control respectively the left and right turret 12 rotation and switches 41 and 42 respectively control hydraulic motor 72 rotation for inward and outward winch line 21 movement. Two stage switches 43 and 44 respectively control the retraction and extension of inside boom segment 15. FIG. 4 likewise illustrates two positioned three-way unloading valve 58, adjustable pressure switch 57 and solenoids 46–53 which control four (4) hydraulic valves (not shown) within directional control valve assembly 24 as seen in FIG. 5. A conventional step-down transformer 98 is joined to 5 amp circuit breaker 99, which is joined to main power switch 100 and to 220 AC power source 101. (normally open) motor relay 102 is seen joined to pendant on/off switch 36 and to pump motor 33 in FIG. 4.

In operation, directional control valve assembly 24 as schematically ,shown in FIG. 5 having 4 valves (not shown) which control the two hydraulic boom lift cylinders 17 (for boom raising) and 22 (for boom extension) and two hydraulic motors (71 for turret rotation and 72 for winch rotation). Directional control valve assembly 24 is also electrically operated with one solenoid for each function, thus a total of eight solenoids, 46–53, two for each valve, are seen in FIG. 4.

Pendant control 19 contains two-step push button switches 37–44, one (1) pendant on/off switch 36 and one (1) pendant power light 35. The lower or number two (#2) stage position on all two-step switches 37–44 are connected in parallel to allow activation of the single, two position, three-way unloading valve 58 in any function demand.

During idle mode, (with electric pump motor 33 and double pump unit 34 running, but with no demand for function) fluid from the low volume pump 61 flows directly to and through the directional control valve assembly 24 and returns to fluid tank 27, without restriction, due to the nature of the series/parallel circuit arrangement of the directional control valve assembly and fluid from the high volume pump 62 flows through the two position, three-way n/o unloading valve 58 directly to fluid tank 27, without restriction.

To create a demand for a given function, one of the two-stage switches 37–44 must be depressed to the first stage. This will energize one (1) of the solenoids 46–53 on the directional control valve assembly 24 and allow the valve (not shown) relative to this signal to shift and divert fluid to a given function component. (i.e., cylinder or motor). This first stage is low speed because high volume pump 62 is unloading to fluid tank 27 through the three-way n/o valve 58. To generate high speed for this same function, it is necessary to depress the two stage switches 37–44 further, "making" both sets of contacts within the switch. The first stage has already energized a valve on directional control valve assembly 24 allowing low volume fluid flow to a function component.

Closing the second stage of switches 37–44 brings into play the two position, three-way unloading valve 58, which no longer unloads to fluid tank 27. Valve 58 has now shifted to close the open-to-tank port (not shown) at the same time opening another port (not shown) allowing fluid from the high volume pump 62 to flow across check valve 26 and join with the low volume pump 61 flow, giving a much higher volume of fluid flow to the given function component. This increased volume generates the higher speed in the function component (i.e., cylinder or motor). Also connected in this circuit is an adjustable pressure switch 57.

Adjustable pressure switch 57 is joined into the fluid line 74 between double pump unit 34 and directional control valve assembly 24 as seen in FIG. 5. Adjustable pressure switch 57 is normally closed (n/c) and is wired in series with the two position, three-way solenoid unloading valve 58. Adjustable pressure switch 57 is necessary to prevent low and high volume pumps 61 and 62 from stalling fractional horsepower electric drive pump motor 33 to drive both low/high volume pumps 61 and 62 to maximum system pressure. However, there is enough horsepower to drive the low volume pump 61 to maximum pressure. With adjustable pressure switch 57 set to a proper value below maximum system pressure, adjustable pressure switch 57 will open the n/c electrical circuit allowing the two position, three-way unloading valve 58 to shift to its n/o position, unloading high volume pump 62 once again to fluid tank 27 and prevent pump motor 33 from stalling, even when one of switches 35–44 is still fully depressed to the second stage position.

Check valve 26 prevents fluid from low volume pump 61 from seeking the path of least resistance through the two position, three-way valve 58 and back to tank 27 hence, there would be no low speed function without check valve 26 installed as shown.

Figure 7:
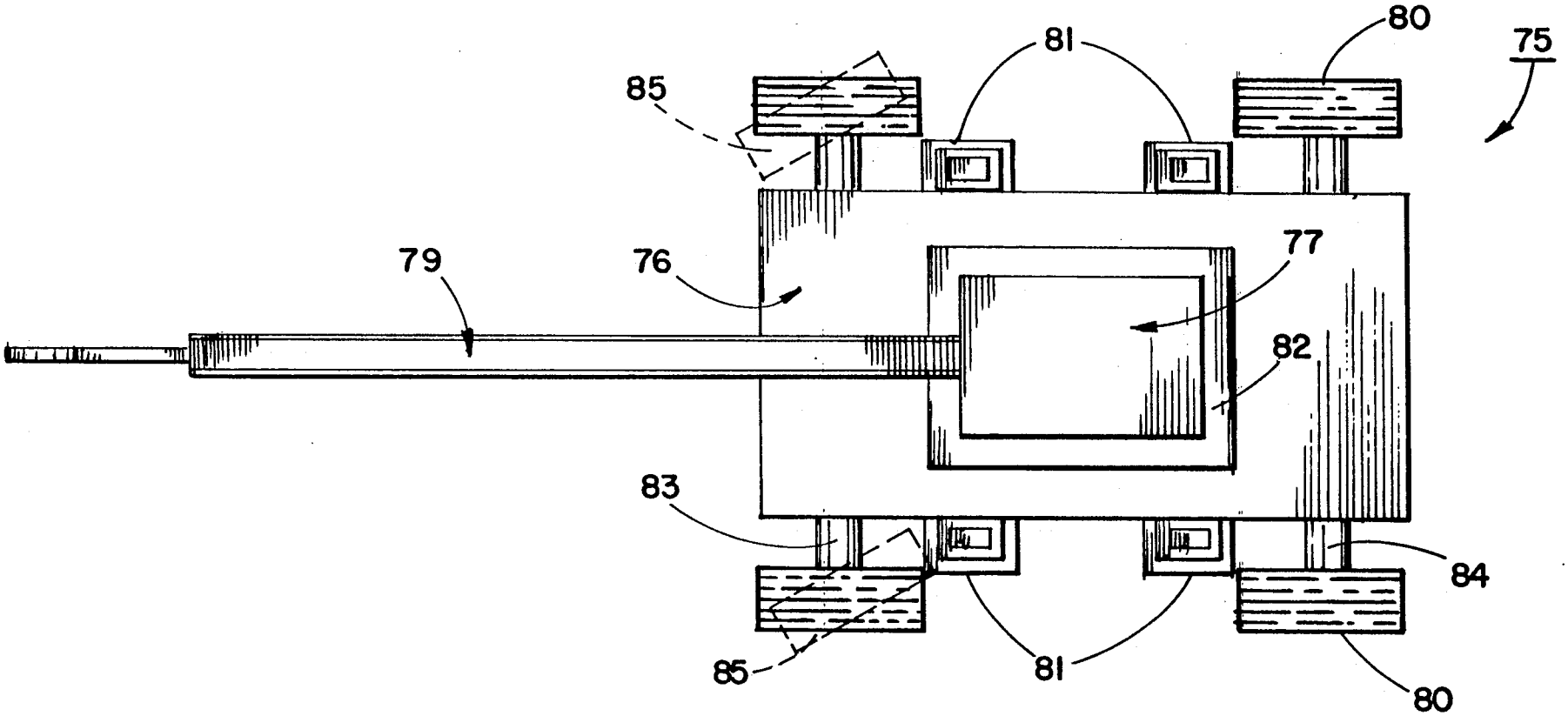
FIG. 7 illustrates a second embodiment of the crane apparatus on a manually movable cart.
Figure 8:
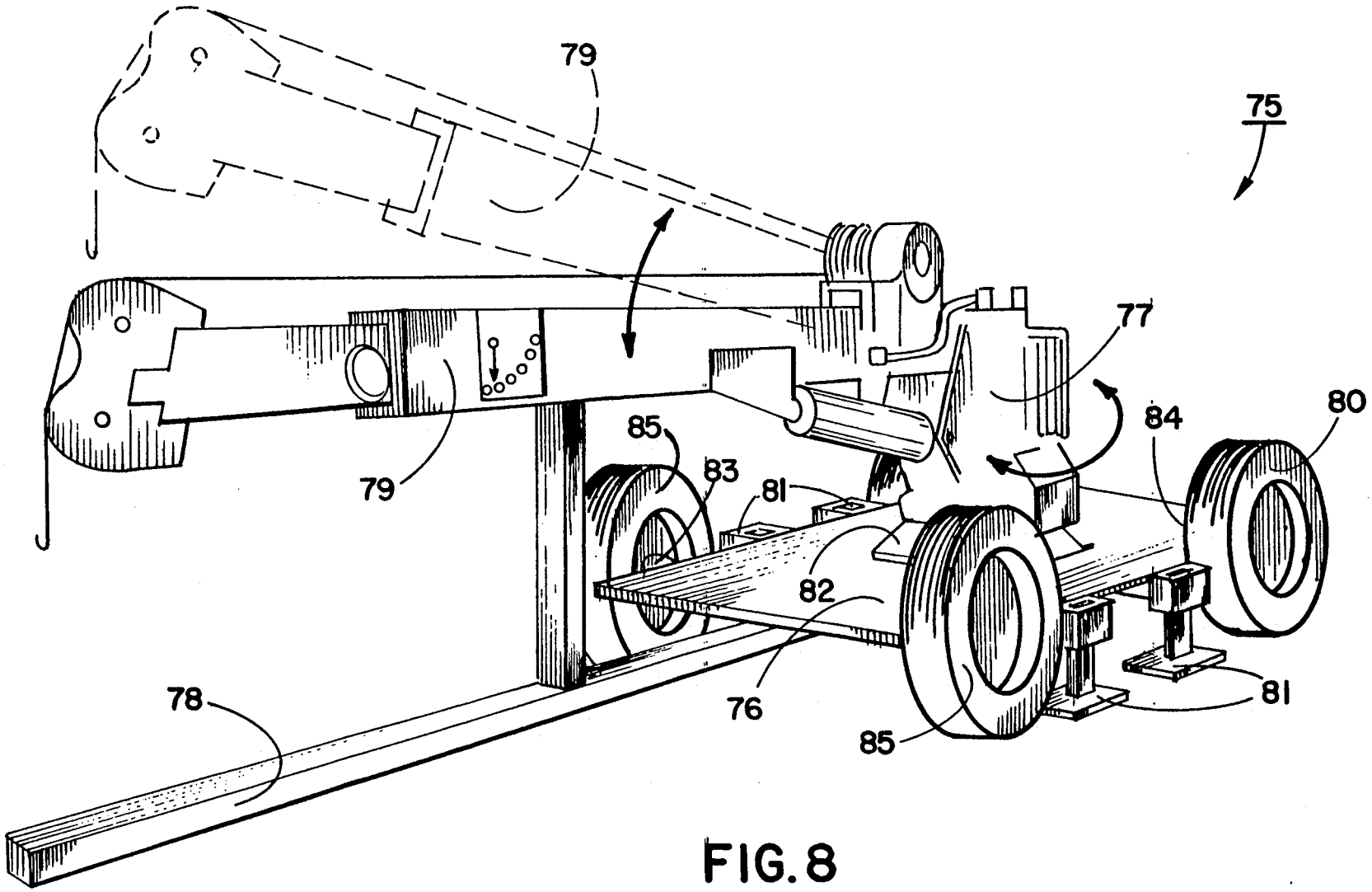
FIG. 8 shows the crane apparatus of FIG. 7 in a side elevational view.

A second embodiment of the crane apparatus is shown in FIGS. 7 and 8 whereby crane turret 77 is mounted on base 82 on crane cart 76. Crane cart 76 can be pulled by tongue 78 for use inside buildings during construction or for handling heavy machinery. Crane cart 76 includes axles 83 and 84 which utilize rear wheels 80 and front wheels 85. Front wheels 85 are steerable and the second embodiment of crane apparatus 75 as shown in FIGS. 7 and 8 is powered by a conventional AC power line of required voltage. Outriggers 81 are conventional stabilizing units which are manually lowered and locked into place as required during use of crane boom 79.

The illustrations and examples provided herein are for explanatory purposes and are not intended to limit the scope of the appended claims.

I claim:

1. In a crane apparatus having a base, a turret rotatably mounted on said base for movement about a vertical axis, a hydraulic actuator for rotating said base, a boom with an inside extendable segment and a outside segment, a hydraulic actuator for moving said inside extendable segment relative to said outside segment, means for mounting said boom on said turret, a winch with a lead line, means mounting said winch and said lead line on said boom, a hydraulic actuator for driving said winch, a hydraulic source and circuit therefor, a high volume pump and a low volume pump connected to said hydraulic source, means for driving said pumps, a directional control valve assembly for directing hydraulic fluid from said pumps to said hydraulic actuators, the improvement comprising:

a pendant control device, an electrical cord with first and second ends, said cord being connected to said device at one of said ends and removably connected to said base at the other one of said ends, said device including a plurality of parallel connected two-stage switches for controlling said hydraulic actuators, each of said switches when actuated to a first stage being operative to drive a respective hydraulic actuator at a low speed and when actuated to a second stage being operative to drive a respective hydraulic actuator at a high speed relative to said low speed;

a normally open electrically operated pump unloading valve connected to said high volume pump and a normally closed pressure switch connected in series with said electrically operated unloading valve;

each of said two-stage switches when actuated to said first stage being operative to place said directional control valve assembly in fluid communication with only said low volume pump to drive a selected hydraulic actuator at said low speed;

each of said two-stage switches when actuated to said second stage being operative to close said unloading valve to place said directional control valve assembly in fluid communication with said high volume pump whereby said low volume pump and said high volume pump are concurrently operated to supply fluid to a selected hydraulic actuator to drive it at said high speed; and said pressure switch being operative to open said unloading valve in response to a predetermined pressure in said hydraulic circuit when a hydraulic actuator is driven at high speed to prevent the stalling of said means for driving said pumps.

2. Crane apparatus as claimed in claim 1 wherein said switches include an on/off switch.

3. Crane apparatus as claimed in claim 1 wherein said switches include dual function switches.

4. Crane apparatus as claimed in claim 3 wherein said switches include dual function switches for:

(a) turret rotation;

(b) boom raising/lowering;

(c) boom extension/retraction; and (d) winch rotation.

5. Crane apparatus as claimed in claim 1 wherein said pendant includes a power light.

* * * * *